US006978108B2

(12) United States Patent
Sakamaki

(10) Patent No.: US 6,978,108 B2
(45) Date of Patent: Dec. 20, 2005

(54) DEVELOPING APPARATUS TO CONTROL BENDING OF A MAGNETIC FIELD GENERATION UNIT PROVIDED INSIDE A DEVELOPER CARRYING MEMBER

(75) Inventor: Tomoyuki Sakamaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/458,364

(22) Filed: Jun. 11, 2003

(65) Prior Publication Data

US 2003/0235437 A1 Dec. 25, 2003

(30) Foreign Application Priority Data

Jun. 19, 2002 (JP) ..... 2002-179122

(51) Int. Cl.[7] ..... G03G 15/08

(52) U.S. Cl. ..... 399/267; 399/104; 399/258; 399/269; 399/274; 399/275; 399/281; 399/282

(58) Field of Search ..... 399/269, 274, 399/275, 104, 258, 281, 267, 282

(56) References Cited

U.S. PATENT DOCUMENTS 4,030,447 A 6/1977 Takahashi et al. ..... 118/658
5,923,933 A * 7/1999 Anzai et al. ..... 399/269
5,995,790 A * 11/1999 Takeda ..... 399/274
6,055,401 A * 4/2000 Tonomoto et al. ..... 399/269
6,269,235 B1 * 7/2001 Nishiyama ..... 399/267
2002/0022190 A1 * 2/2002 Iizuka et al. ..... 430/110.4

FOREIGN PATENT DOCUMENTS

JP 51-43151 4/1976

* cited by examiner

*Primary Examiner*—Arthur T. Grimley
*Assistant Examiner*—Peter Lee
(74) *Attorney, Agent, or Firm*—Fitzpatrick, Cella, Harper & Scinto

(57) ABSTRACT

To control bending of a magnetic field generation unit provided inside a developer carrying member, a developing apparatus for developing an electrostatic image formed on an image bearing member according to the present invention includes: a developer container which contains a magnetic developer; first and second developer carrying members which carry the developer in the developer container to the image bearing member; and first and second magnetic field generation units which are fixedly arranged in the first and second developer carrying members. In the developing apparatus, the first magnetic field generation unit and the second magnetic field generation unit form a magnetic field for delivering the developer from the first developer carrying member to the second developer carrying member, and the developing apparatus further includes a magnetic unit which exerts a magnetic force, which resists a magnetic force caused by the magnetic field, on the first and second magnetic field generation units.

3 Claims, 7 Drawing Sheets

DEVELOPING APPARATUS TO CONTROL BENDING OF A MAGNETIC FIELD GENERATION UNIT PROVIDED INSIDE A DEVELOPER CARRYING MEMBER

BACKGROUND OF THE INVENTION

1. Field of the Invention

The present invention relates to a developing apparatus which develops an electrostatic image formed on an image bearing member using an electrophotographic process, an electrostatic recording process, or the like, which is particularly used for a copier, a printer, a facsimile machine, or the like.

2. Related Background Art

In an image forming apparatus such as an electrophotographic copier, conventionally, there is known a developing apparatus according to a powder cloud method, a cascade method, a magnetic brush method, or the like as a developing apparatus to be applied to the image forming apparatus. These methods have different characteristics and are being put to practical use in various fields according to the respective characteristics.

Among these methods, in the case of the powder cloud method and the cascade method, a developing toner is concentrated on a part with a large electric field gradient of an electrostatic latent image formed on a surface of an image bearing member such as a photosensitive drum, that is, a part where an original image concentration is discontinuous, and a reproduced image to be obtained is emphasized in this part. Since a so-called edge effect is generated, these methods are advantageous in reproducing copy of a business document image such as characters, that is, line copy. However, the edge effect becomes a disadvantage in reproduction of a general gradation image (image including a halftone concentration), that is, reproduction of a part where a concentration of an original image changes continuously. Thus, these methods are not suitable for, for example, a full-color copier which is required of a high image quality.

In addition, in the case of both the powder cloud method and the cascade method, since an area where a developer acts on a photosensitive drum needs to be made larger, there is another disadvantage in that a volume of the developing apparatus itself increases.

On the other hand, in the case of the magnetic brush method of a two component development process, an image is formed by making a two component developer, which includes a magnetic carrier, a toner, and the like in a mixed form, to adhere to magnetic field generation means; causing the developer to stand like magnetic bead chains in a brush shape in magnetic pole parts; and then developing an electrostatic latent image on a photosensitive drum by rubbing the same. In this case, since the magnetic carrier itself in the developer functions as a soft development electrode, it is possible to deposit the toner in proportion to a charge density of the electrostatic latent image. That is, the magnetic brush method is suitable for reproduction of a gradation image. In addition, the magnetic brush method also has a characteristic that the developing apparatus itself can be constituted in a small size.

As further improvement of this magnetic brush developing apparatus of the two component development process, a magnetic brush development method using a developing sleeve serving as a developer carrying member is generally used. In order to attain an object of developing an electrostatic latent image on a photosensitive drum efficiently, a two component developer including a magnetic carrier, which is a powder of a magnetic material such as ferrite, and a toner with a pigment scattered in a resin is agitated to be mixed, and the toner is given charges by triboelectrification due to friction of the magnetic carrier and the toner. Meanwhile, this developer is held in a developing sleeve serving as a hollow cylindrical developer carrying member made of a nonmagnetic material having magnetic poles in the inside thereof. The developer is carried to a development area opposed to the photosensitive drum from a developer container by the developing sleeve, and the developer is caused to stand like magnetic bead chains by the action of the magnetic field in this development area to rub the surface of the photosensitive drum, whereby the electrostatic latent image formed on the photosensitive drum is developed.

This two component magnetic brush development method using a developing sleeve is used in many products such as a monochrome digital copier and a full-color copier which are required of a high image quality.

Up to now, in the case in which a rotation movement speed of a photosensitive drum is relatively low, that is, in the case of copier having a relatively low operation speed, a satisfactory developed image can be obtained even in a short development time and thus, it is sufficient to provide only one development sleeve. However, in the case in which the rotation movement speed of the photosensitive drum increases due to the recent tendency of requiring high operation speed of a copier, preferable image formation is not always performed with only one developing sleeve.

As a measure to cope with the situation, there is a method of increasing development efficiency by increasing a peripheral speed of the developing sleeve. However, if the peripheral speed of the developing sleeve is increased, a centrifugal force acting on the developer forming the magnetic brush increases causing a larger amount of developer to scatter, thus contaminating the inside of the copier, which would result in deterioration of functions of the apparatus.

As another measure, there is proposed a method of creating a repulsive magnetic field by arranging two magnetic poles of the same polarity side by side so as to be opposed to a development area and causing the developer to stand like magnetic bead chains under the created magnetic field in order to increase a width of the magnetic bead chains of a brush shape in the development area to develop an image more efficiently (Japanese Patent Application No. 49-116899; see Japanese Patent Laid-Open Application No. 51-43151).

In this method, as a magnetic pole arrangement in the developing sleeve for holding the developer for development and causing the developer to stand like magnetic bead chains in a magnetic pole part, and in particular an arrangement of development magnetic poles for causing the developer on the developing sleeve to stand like magnetic bead chains opposed to the photosensitive drum, it is extremely effective in terms of the development efficiency to provide the magnetic poles for forming the repulsive magnetic field.

However, in the repulsive magnetic field of the development poles opposed to the photosensitive drum, since a magnetic force for holding the magnetic carrier in the developing sleeve extremely decreases, the magnetic carrier deposits on the photosensitive drum to spoil an image quality, and preferable image formation cannot always be performed.

Thus, as a further measure to cope with the above-mentioned situation, a so-called multi-stage magnetic brush development method is being proposed in which two or more developer carrying members such as developing sleeves are arranged with peripheral surfaces thereof adjacent to each other to be placed side by side such that the developer is carried continuously through the respective peripheral surfaces, thereby extending a development time to increase development capability.

Here, FIG. 7 shows an example of the conventional developing apparatus of the multi-stage magnetic brush development process provided with two developing sleeves.

A developing apparatus 101 is provided with a developer container 2 arranged in parallel with a photosensitive drum 21. The inside of the developer container 2 is sectioned into a development chamber R1 and an agitation chamber R2 by a partition wall 3 parallel with the photosensitive drum 21. A toner storage chamber R3 is provided above the agitation chamber R2, and a supply toner 11 is stored therein. A toner 11 of an amount offsetting a toner consumed in development is dropped to be supplied into the agitation chamber R2 from a supply port 12 in the lower part of the toner storage chamber R3. On the other hand, a developer 13 in which the toner particles and magnetic carriers are mixed is stored in the development chamber R1 and the agitation chamber R2.

A carrying screw 4 is housed in the development chamber R1 and is rotationally driven to carry the developer 13 along a longitudinal direction parallel with the photosensitive drum 21 of the developer container 2. A screw 5 carries the developer in a direction opposite to the direction in which the carrying screw 4 carries the developer.

Openings are provided in the front side and the back side in the partition wall 3. The developer 13 carried by the screw 4 is received by the screw 5 from one of the openings, and the developer 13 carried by the screw 5 is received by the screw 4 from the other of the openings.

An opening portion is provided in a portion of the developer container 2 adjacent to the photosensitive drum 21. In the opening portion, two developer carrying members, namely, a first developing sleeve 6 and a second developing sleeve 9 formed of a nonmagnetic material are provided.

The first developing sleeve 6, which is opposed to the photosensitive drum 21 on an upstream side in a rotating direction a, of these two developer carrying members rotates in a direction of arrow b (direction opposite to the rotating direction a of the photosensitive drum 21) and is regulated to an appropriate developer layer thickness by a developer regulating member of a blade shape (layer thickness regulating blade) 8, which is arranged further upstream than a first development area 14 in the rotating direction of the developing sleeve 6, i.e., at an upper end of an opening of the developer container 2. Then, the first developing sleeve 6 carries the developer 13 to the first development area 14.

First magnetic field generation means (magnetic roller) 7 of a roller shape is fixedly arranged in the developing sleeve 6. This first magnetic roller 7 has a development magnetic pole S1 opposed to the first development area 14. A magnetic brush of a developer is formed by a development magnetic field which the development magnetic pole S1 forms in the first development area 14. This magnetic brush comes into contact with the photosensitive drum 21 rotating in the direction of arrow a in the first development area 14 to develop an electrostatic latent image in this first development area 14.

The first magnetic roller 7 has poles N1, N2, N3, and S2 other than the development magnetic pole S1. Among them, the poles N2 and N3 having the same polarity are adjacent to each other in the developer container 2, whereby a barrier is formed against the developer 13.

A second developing sleeve 9 serving as a second developer carrying member is rotatably disposed in a direction of arrow c in an area below the first developing sleeve 6, on the downstream side in the rotating direction a of the photosensitive drum 21, and substantially opposed to both the first developing sleeve 6 and the photosensitive drum 21. This second developing sleeve 9 is formed of a nonmagnetic material in the same manner as the first developing sleeve 6. A second magnetic roller 10 of a roller shape serving as second magnetic field generation means is arranged inside the second developing sleeve 9 in a non-rotating state. This second magnetic roller 10 has three poles, S3, S4, and N4.

As a flow of the developer 13, the developer 13 is carried through the poles N2, S2, N1, S1, and N3 in this order on the first developing sleeve 6 and then, the developer on the first developing sleeve 6 is moved to the second developing sleeve 9 to be carried through the poles S3, N4, and S4 in this order.

Among these magnetic poles, the pole N4 is in contact with the photosensitive drum 21 in a part where the second developing sleeve 9 and the photosensitive drum 21 are opposed to each other, that is, a second development area 15, where development is conducted for the second time on the electrostatic latent image on the photosensitive drum 21 which has passed the first development area 14. In this way, by performing the development for the second time, high development efficiency can be attained.

As described above, the developing apparatus is provided with two developing sleeves, whereby, for example, even if a development time is reduced following increase in a peripheral speed of a photosensitive drum, high development efficiency can be attained and image formation can be performed satisfactorily without causing a decrease in a development concentration and occurrence of concentration unevenness.

However, in the conventional example using the first developing sleeve 6 and the second developing sleeve 9, a magnetic attraction force works between the first magnetic roller 7 inside the first developing sleeve 6 and the second magnetic roller 10 inside the second developing sleeve 9, which is liable to cause a problem in that central parts of both the first magnetic roller 7 and 1 the second magnetic roller 10 bend.

As an example of a cause of the magnetic attraction force between the magnetic rollers 7 and 10, there is given such a fact that the opposed poles of both the magnetic rollers 7 and 10 (poles N3 and S3) are poles of opposite polarities. However, if these two poles are poles of the same polarity, since a magnetic field is not formed between both the poles and it is highly likely that delivery of a developer from the first developing sleeve 6 to the second developing sleeve 9 is not performed smoothly, these poles are often made opposite.

When the bending of the magnetic rollers 7 and 10 occurs, first, parts of the magnetic rollers 7 and 10 come into contact with inner walls of the developing sleeves 6 and 9 to generate a frictional force, which leads to requirement of a large force for development drive, causing, in some cases, the developing sleeves 6 and 9 to stop (lock) due to a too large load.

As a measure to cope with this problem, it is possible that a sufficient margin is secured between the outer diameters of the magnetic rollers 7 and 10 and the inner walls of the developing sleeves 6 and 9. However, in addition to using the two developing sleeves initially, if the developing sleeves are enlarged, this leads to an increase in size of the developing apparatus. This is inappropriate, for example, in the case in which four developing apparatuses are used as in a full-color copier, or in terms of marked demand for reduction in size of a copier and costs. Conversely, reducing an outer diameter of a magnetic roller means reduction in a volume of a magnet of the magnetic roller, which makes it highly likely that it becomes difficult to obtain a magnetic force suitable for development.

In addition, even if the sufficient margin can be secured and the outer diameter of the magnetic roller and the inner wall of the developing sleeve do not come into contact with each other, a problem described below is unavoidable. That is, if the magnetic roller bends, a distribution of a magnetic force on a surface of the developing sleeve becomes non-uniform, and coating of a developer on the developing sleeve becomes non-uniform. It is highly likely that such coating unevenness adversely affects an image.

Therefore, as a measure to cope with the above-mentioned problem, it is necessary to eliminate the bending itself. Usually, a magnetic roller is often manufactured with a magnet provided around a shaft core rod made of metal, and it is possible that a diameter of the shaft core rod is increased so as to enhance strength of the roller as means to cope with the bending. However, since increasing the diameter of the shaft core rod leads to reduction in a volume of a magnet part, it is highly likely that it becomes difficult to obtain a magnetic force suitable for development as in the above-mentioned case of reducing the outer diameter of the magnet.

In particular, if a developing sleeve with a small diameter of 25 mm or less is used, a diameter of the magnetic roller has to be reduced as well. Accordingly, the shaft core rod tends to be made as thin as possible in order to obtain a magnetic force. Thus, it is difficult to obtain a magnetic force suitable for development.

SUMMARY OF THE INVENTION

It is an object of the present invention to provide a developing apparatus which can control bending of magnetic field generation means provided inside a developer carrying member.

It is another object of the present invention to provide a developing apparatus which can prevent bending of the magnetic field generation means provided inside the developer carrying member.

Further objects of the present invention will be apparent from the following detailed description with reference the accompanying drawings.

DESCRIPTION OF THE PREFERRED EMBODIMENTS

A developing apparatus and an image forming apparatus in accordance with the present invention will be hereinafter described more in detail with reference to the accompanying drawings.

First Embodiment

Figure 1:
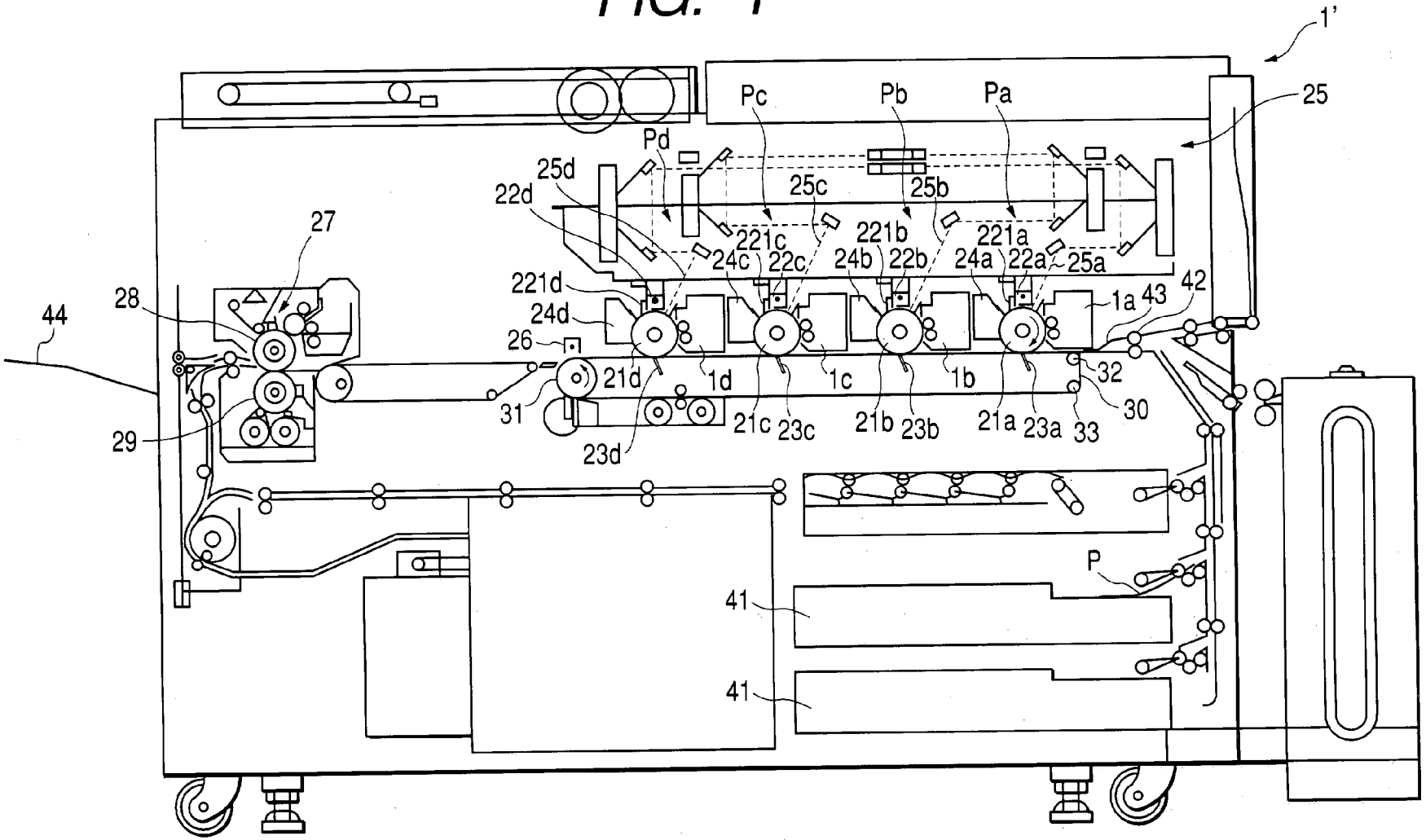
FIG. 1 is a schematic diagram showing an example of an image forming apparatus in accordance with the present invention.

A schematic structure which is an embodiment of a color electrophotographic image forming apparatus will be described more in detail with reference to FIG. 1. However, the present invention is not limited to this embodiment. This embodiment will be described using a color electrophotographic image forming apparatus, which has a plurality of image bearing members and is equipped with a plurality of image forming sections constituted by image forming means provided for each of the image bearing member, as an image forming apparatus. FIG. 1 is a sectional explanatory view showing an overall structure of an image forming apparatus 1'.

Inside a main body of the image forming apparatus 1', image forming sections Pa, Pb, Pc, and Pd incorporating process means such as image bearing members are arranged in a horizontal direction, and an endless transfer belt 30 serving as a transfer material conveying member, which is wound around belt drive rollers 31, 32, and 33, is set below the image forming sections Pa, Pb, Pc, and Pd. The transfer belt 30 rotates the belt drive roller 31 in a direction along a rotation direction of the respective image bearing members with a not-shown drive motor.

A cassette 41 contains recording sheets P, which are recording mediums, stacked therein. The stacked recording sheets P contained in the cassette 41 are fed from a top one. Then, skew feeding of the recording sheets P is corrected by a registration roller pair 42 and, at the same time, the recording sheets P are conveyed onto the transfer belt 30 synchronizing with an image forming operation of the image forming sections Pa, Pb, Pc, and Pd. A conveyance guide 43 guides the recording sheets P to the transfer belt 30 with the registration roller pair 42.

Next, a structure of the image forming sections Pa, Pb, Pc, and Pd will be described. The image forming sections Pa, Pb, Pc, and Pd have photosensitive drums 21*a*, 21*b*, 21*c*, and 21*d* serving as image bearing members. Around the photosensitive drums 21*a*, 21*b*, 21*c*, and 21*d*, there are provided primary chargers 22*a*, 22*b*, 22*c*, and 22*d* serving as charging means constituting the process means, developing apparatuses 1*a*, 1*b*, 1*c*, and id serving as developing means, transfer chargers 23*a*, 23*b*, 23*c*, and 23*d* serving as transfer means, cleaning devices 24*a*, 24*b*, 24*c*, and 24*d* serving as cleaning means, and pre-exposure light sources 221*a*, 221*b*, 221*c*, and 221*d*, respectively. In addition, a laser beam scanner 25 serving as electrostatic latent image forming means is provided above the photosensitive drums 21*a*, 21*b*, 21*c*, and 21*d*.

The primary chargers 22*a* to 22*d* uniformly charge surfaces of the photosensitive drums 21*a* to 21*d* prior to exposure thereof. The developing apparatuses 1*a* to 1*d* deposit toners of black, magenta, yellow, and cyan serving as developers on electrostatic latent images, which are formed on the photosensitive drums 21*a* to 21*d* through exposure, to visualize the electrostatic latent images as toner images. In addition, the transfer chargers 23*a* to 23*d* transfer the toner images formed on the photosensitive drums 21*a* to 21*d* to the recording sheets P placed on the transfer belt 30. The cleaning devices 24*a* to 24*d* remove transfer residual toners deposited on the surfaces of the photosensitive drums 21*a* to 21*d* after the transfer of the toner images. The pre-exposure light sources 221*a* to 221*d* eliminate charges of surface potentials of the photosensitive drums 21*a* to 21*d*. The laser beam scanner 25 has a semiconductor laser, a polygon mirror, an fθ lens, and the like. The scanner receives an input of an electric digital image signal, and irradiates laser beams 25*a*, 25*b*, 25*c*, and 25*d*, which are modulated according to the signal, in a bus direction of the photosensitive drums 21*a* to 21*d* to expose the surfaces of the photosensitive drums.

A separation charger 26, which is located downstream the image forming sections Pa to Pd in a moving direction of the transfer belt 30, separates the recording sheets P conveyed onto the transfer belt 30. A fixing device 27 is fixing means for fixing the image transferred to the recording sheets P, and has a fixing roller 28 having heating means such as a heater in the inside thereof and a pressure roller 29 which comes into press-contact with the fixing roller 28. A discharge tray 44 is for stacking the recording sheets P delivered to the outside of the apparatus.

Next, an image forming operation will be described. When an image forming operation start signal is inputted to the main body of the image forming apparatus 1', the photosensitive drums 21*a* to 21*d* start rotating in a direction of arrow and are uniformly charged by the primary chargers 22*a* to 22*d*. Then, in an exposure process, the laser beams 25*a* to 25*d*, which are modulated according to an image signal corresponding to a black component of an original image, are irradiated on the surfaces of the photosensitive drums 21*a* to 21*d* by the laser beam scanner 25, whereby electrostatic latent images are formed.

Subsequently, in the image forming sections Pa to Pd, when the electrostatic latent images reach the positions 1*a* to 1*d* of the developing apparatuses in accordance with the rotation of the photosensitive drums 21*a* to 21*d*, the developers (toners) of black, magenta, yellow, and cyan are supplied by the developing apparatuses 1*a* to 1*d*, respectively, and developer images (toner images), which are obtained by visualizing the electrostatic latent images, are formed.

On the other hand, the recording sheets P guided onto the transfer belt 30 are corrected of the skew feeding thereof by the registration roller pair 42 temporarily stopped, conveyed to a position (transfer section) opposed to the photosensitive drum 21*a* of the image forming section Pa by the rotation of the transfer belt 30 taking timing with the black toner image formed on the photosensitive drum 21*a*. In the transfer section of the image forming section Pa, the recording sheets P are subjected to transfer charging by the transfer charger 23*a* provided inside the transfer belt 30, and the black toner image is transferred to the recording sheets P. Such a transfer process is also performed in the image forming sections Pb, Pc, and Pd in the same manner, and a magenta toner image, a yellow toner image, a cyan toner image are sequentially transferred to the recording sheets P so as to be superimposed with each other, whereby a color image is formed.

The recording sheets P for which the image transfer has been finished are separated from the transfer belt 30 while being subjected to AC charge elimination by the separation charger 26 at a left end of the transfer belt 30 and are conveyed to the fixing device 27. Then, the recording sheets P subjected to the image fixing by the fixing device 27 are discharged to the discharge tray 44 in the outside of the apparatus.

Figure 2:
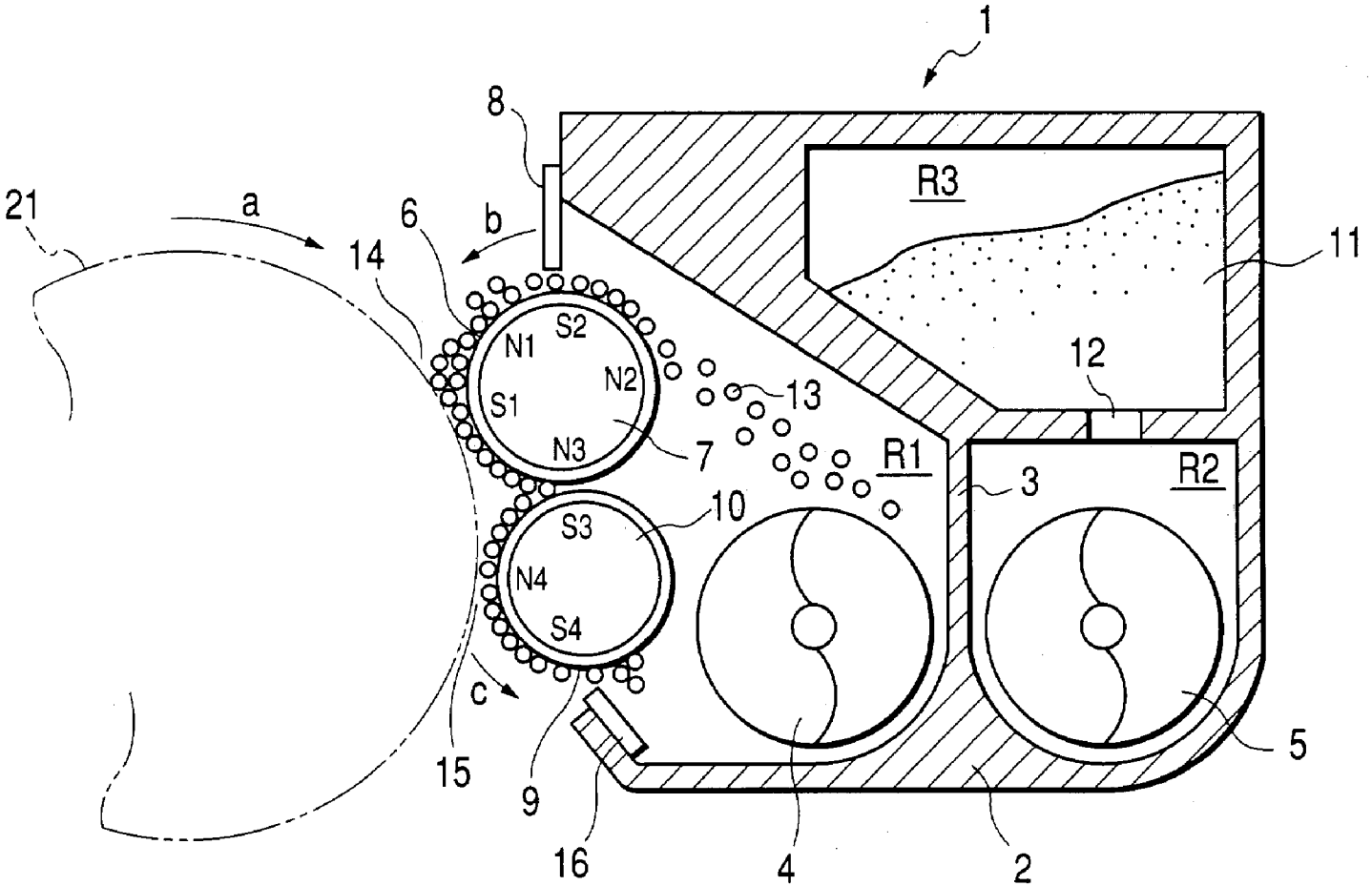
FIG. 2 is a sectional view showing an example of a developing apparatus in accordance with the present invention.

Here, the developing apparatus of this embodiment will be described in detail with reference to FIG. 2. Note that, since the developing apparatuses 1*a* to 1*d* used in the main body of the image forming apparatus 1' of this embodiment adopt the identical structure, these will be collectively described as a developing apparatus 1. In the following description, the developing apparatus 1 may indicate any of the developing apparatuses 1*a*, 1*b*, 1*c*, and 1*d*.

A developing apparatus 1 is provided with a developer container 2 containing a developer including nonmagnetic toner particles and magnetic carriers as a magnetic developer. The structure of the inside of the developer container 2 is the same as that of the conventional developing apparatus 101 and is sectioned into a development chamber R1 and an agitation chamber R2 by a partition wall 3. A toner storage chamber R3 is provided above the agitation chamber R2, and a supply toner 11 is stored therein.

A toner of an amount offsetting a toner consumed in development is dropped to be supplied into the agitation chamber R2 from a supply port 12 in the lower part of the toner storage chamber R3. On the other hand, a developer 13 in which the toner particles and magnetic carriers are mixed is stored in the development chamber R1 and the agitation chamber R2. As the magnetic carrier used in the present invention, it is sufficient to use a ferrite carrier, a resin magnetic carrier including a binder resin and magnetic metal oxide and nonmagnetic metal oxide, or the like. The developer 13 in the developer container 2 is agitated and carried by screws 4 and 5 in the developer container 2. The screws 4 and 5 are rotatably provided in the developer container 2 via bearings in the vicinity of both ends in a rotation axis direction thereof.

Further, as in the developing apparatus 101 of the conventional example, an opening portion is provided in a portion of the developer container 2 adjacent to the photosensitive drum 21. In the opening, there are provided two developing sleeves serving as developer carrying members, namely, a first developing sleeve 6 and a second developing sleeve 9 which are formed of a material such as aluminum or nonmagnetic stainless steel and have moderate unevenness on surfaces thereof. These developing sleeves are provided rotatably in the developing container 2 via bearings in the vicinity of both ends in a rotation axis direction thereof.

In this embodiment, diameters of the two developing sleeves 6 and 9 are set to 20 mm. In the color electrophotographic image forming apparatus 1' as in this embodiment, four developing apparatuses and two developing sleeves for each developing apparatus are provided, i.e., eight developing sleeves in total are provided in the image forming apparatus 1'. Increasing the diameters of these developing sleeves means an increase in the size of the apparatus. Therefore, the diameters are set to be small.

The first developing sleeve 6 rotates in a direction of arrow b along the rotating direction a of the photosensitive drum 21 (direction opposite to the rotating direction a of the photosensitive drum 21) at a peripheral speed of Vb. The photosensitive drum 21 is equivalent to the photosensitive drums 21*a* to 21*d*. Then, the first developing sleeve 6 draws the developer 13, which is contained in the developer container 2 and agitated, up to the surface of the photosensitive drum 21 to carry the developer 13. The developer 13 is regulated to an appropriate developer layer thickness by a layer thickness regulating blade 8 serving as a developer regulating member, and then carried to the first development area 14. The layer thickness regulating blade 8 is provided upstream the first development area 14 in the rotating direction b of the developing sleeve 6, that is, provided at an upper end of the opening of the developer container 2. The layer thickness regulating blade 8 will be described later.

Further, a first magnetic roller 7 serving as magnetic field generation means of a roller shape is fixedly arranged in the developing sleeve 6. This first magnetic roller 7 has a development magnetic pole Si in a position opposed to the first development area 14. A magnetic brush of a developer is formed by a development magnetic field which the development magnetic field S1 forms in the first development area 14. This magnetic brush comes into contact with the photosensitive drum 21, which rotates in the direction of arrow a at the peripheral speed of Va, in the first development area 14 to develop an electrostatic latent image in this first development area 14. In this case, a toner depositing on the magnetic brush and a toner depositing on the surface of the developing sleeve 6 are also moved to an image area of the electrostatic latent image to be used for development. In this embodiment, the first magnetic roller 7 has poles N1, N2, N3, and S2 other than the development magnetic pole S1. Among them, the poles N2 and N3 located in the developer container 2 are poles of the same polarity and are arranged adjacent to each other, whereby a barrier is formed against the developer.

A second developing sleeve 9 serving as a second developer carrying member is disposed so as to be rotatable in a direction of arrow c, which is the same as the rotating direction b of the first developing sleeve 6, at a peripheral speed Vc in an area below the first developing sleeve 6 and substantially opposed to both the first developing sleeve 6 and the photosensitive drum 21.

This second developing sleeve 9 is formed of a nonmagnetic material in the same manner as the first developing sleeve 6. A second magnetic roller 10 of a roller shape serving as magnetic field generation means is arranged inside the second developing sleeve 9 in a non-rotating state. This second magnetic roller 10 has three poles, S3, S4, and N4. Among them, the magnetic brush on the pole N4 is in contact with the photosensitive drum 21 in a second development area 15, where development is conducted for the second time on the electrostatic latent image which has passed the first development area 14.

In addition, the poles S3 and S4 of the second magnetic roller 10 located on the inner side of the developer container 2 are poles of the same polarity, and a repulsive magnetic field is formed between the poles S3 and S4, whereby a barrier is formed against the developer 13. Among them, the pole S3 is opposed to the pole N3 of the first magnetic roller 7, which is contained in the first developing sleeve 6, in the vicinity of a position where both sleeves are closest to each other.

Figure 3:
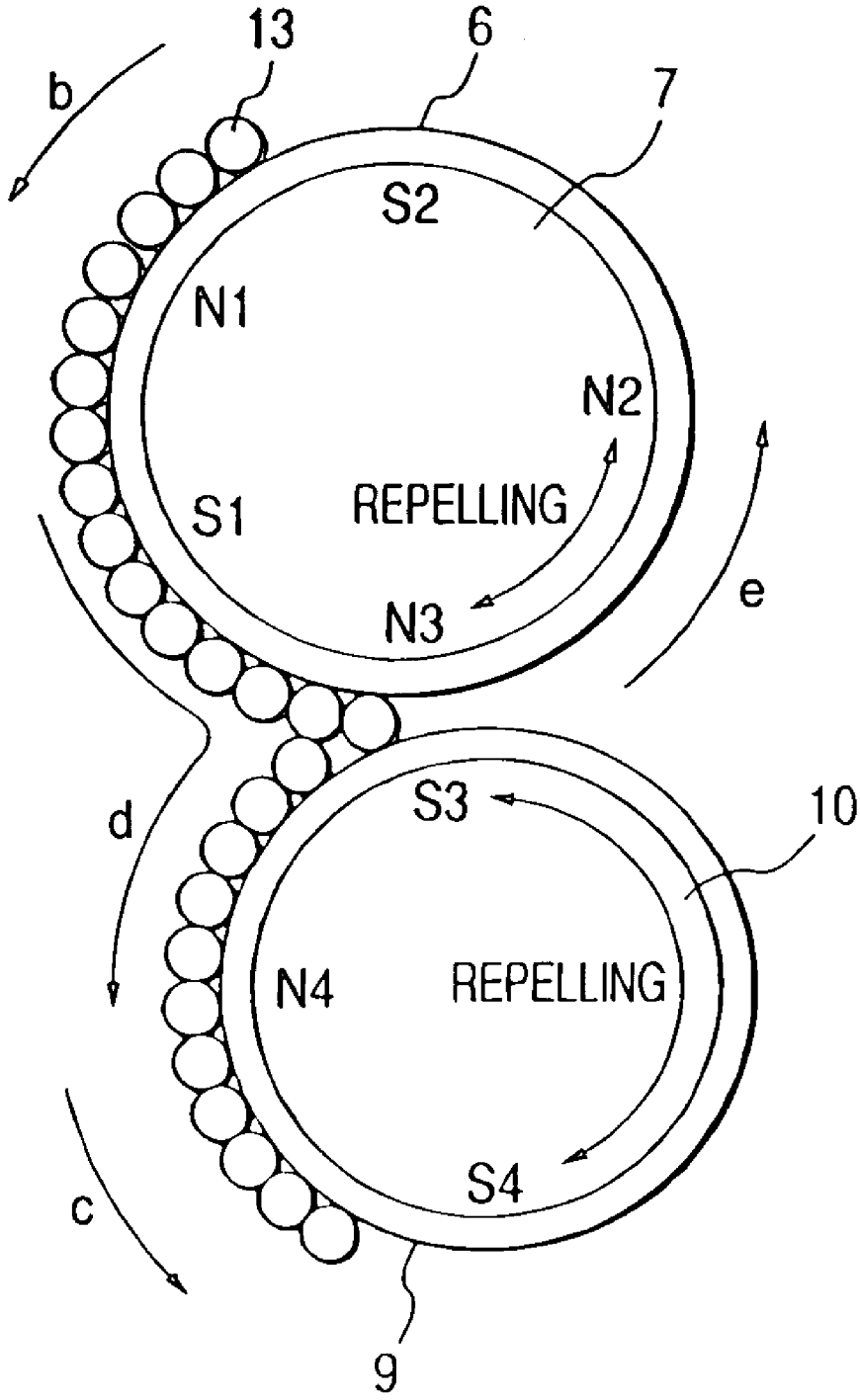
FIG. 3 is an enlarged sectional view showing an example of a developer carrying member in accordance with the present invention.

A flow of the developer 13 will be hereinafter described with reference to FIG. 3 which is an enlarged view of the vicinity of the first developing sleeve 6 and the second developing sleeve 9. A repulsive magnetic field is formed between the poles N3 and N2 of the first magnetic roller 7 in the first developing sleeve 6 located in the developer container 2. In addition, a repulsive magnetic field is also formed between the poles S3 and S4 of the second magnetic roller 10 in the second developing sleeve 9 located in the developer container 2. Thus, even if the developer 13, which has been carried on the first developing sleeve 6 and passed the development area 14, reaches the pole N3, it cannot pass the position where both sleeves 6 and 9 are closest to each other as indicated by arrow e due to the repulsive magnetic fields. The developer 13 moves to the second developing sleeve 9 side following a magnetic line of force d extending in the direction of the pole S3 of the second magnetic roller 10 from the pole N3 of the first magnetic roller 7 as indicated by arrow d and is carried by the second developing sleeve 9 to be carried to a carrying screw 4 in the development chamber R1.

The second developing sleeve 9 is provided below the first developing sleeve 6 as in this embodiment, whereby the developer 13 is carried through the poles N2, S2, N1, S1, and N3 in this order on the first developing sleeve 6. Then, the developer 13 on the first developing sleeve 6 is blocked by the repulsive magnetic fields of both sleeves, moves to the second developing sleeve 9, and is carried through the poles S3, N4, and S4 in this order on the second development sleeve 9 and blocked by the repulsive magnetic field in the pole S4 to be scraped off into the development chamber R1.

Note that, in this developing apparatus 1, since the pole N3 of the first magnetic roller 7 and the pole S3 of the second magnetic roller 10 are opposed to each other between the developing sleeves 6 and 9, which are provided adjacent to each other, and have opposite polarities, the developer 13 is delivered from the first developing sleeve 6 to the second developing sleeve 9 smoothly.

In this case, a distance between the first developing sleeve 6 and the second developing sleeve 9 is preferably 0.1 to 3 mm. More preferably, the distance is 0.5 mm or more, and yet more preferably, 0.8 mm or more. If the distance is smaller than 0.1 mm, a magnetic force between the magnetic rollers 7 and 10 in the two developing sleeves 6 and 9 increases and bending of the magnetic rollers 7 and 10 worsens, which is not preferable. On the other hand, if the distance is more than 3 mm, the magnetic force between the magnetic rollers 7 and 10 decreases, which is advantageous in preventing the bending, but the delivery of the developer 13 between the developing sleeves 6 and 9 may be hindered.

The above-mentioned structure is the same as that of the developing apparatus 101 described in the conventional example. However, as in this embodiment, if the diameters of the developing sleeves 6 and 9 are reduced, as described in the conventional example, the magnetic rollers 7 and 10 serving as magnetic field generation means inside the developing sleeves 6 and 9 have to be reduced in size as well. Thus, it is necessary to increase a volume of magnet parts of the magnetic rollers 7 and 10 as much as possible in order to obtain a magnetic force necessary for development without reducing the size of the developing sleeves 6 and 9. Therefore, it is impossible to secure a margin between the magnetic rollers 7 and 10 and the inner walls of the developing sleeves 6 and 9 or to increase diameters of shaft cores of the magnetic rollers 7 and 10. In addition, the magnetic poles opposed between the developing sleeves 6 and 9, which are provided adjacent to each other, have opposite polarities. As a result, the magnetic rollers 7 and 10 are readily attracted to each other, causing bending to occur easily.

Thus, the present invention provides a method which is effective in the case in which developing sleeves serving as developer carrying members are relatively small as in this embodiment, and which prevents bending while securing a necessary magnetic force in the case in which a diameter of at least one of the two developing sleeves is 25 mm or less and further, even in the case in which the diameter is 20 mm or less.

As means for providing the method, in addition to the structure of the developing apparatus 101 described above, as shown in FIG. 2, this embodiment is characterized in that a second magnetic plate 16 serving as magnetic means is provided so as to be substantially opposed to the magnetic pole of the second developing sleeve 9 located on the opposite side of the first developing sleeve 6, that is, opposite the pole S4, and along a thrust direction of the second developing sleeve 9 within coverage of the magnetic field of the pole S4.

Consequently, the second magnetic plate 16, to which the pole S4 is opposedly arranged, is magnetized, whereby, in addition to the magnetic force by which the pole S3 is attracted to the first magnetic roller 7 inside the first developing sleeve 6, a magnetic force is applied to the second magnetic roller 10 inside the second developing sleeve 9 in an opposite direction. As a result, bending of the second magnetic roller 10 can be prevented.

Note that, in this case, if the second magnetic plate 16 is arranged so as to be opposed to a downstream side in a developer carrying direction in the vicinity of the pole S4, it is possible to form a smoother flow of the developer because a magnetic line of force is formed in a direction toward the developer container 2.

On the other hand, the bending of the first magnetic roller 7 in the first developing sleeve 6 can be also prevented by arranging a first magnetic plate 8 serving as magnetic means in an area substantially opposed to the pole S2 which is a magnetic pole located on the opposite side of the second developing sleeve 9 and by permitting a magnetic force to be applied in a direction opposite to that between the magnetic rollers. Note that, in this embodiment, the first magnetic plate 8 functions also as a regulating blade 8 serving as a developer regulating member for regulating a developer layer thickness by removing an excess developer carried on the developing sleeve 6.

Figure 4:
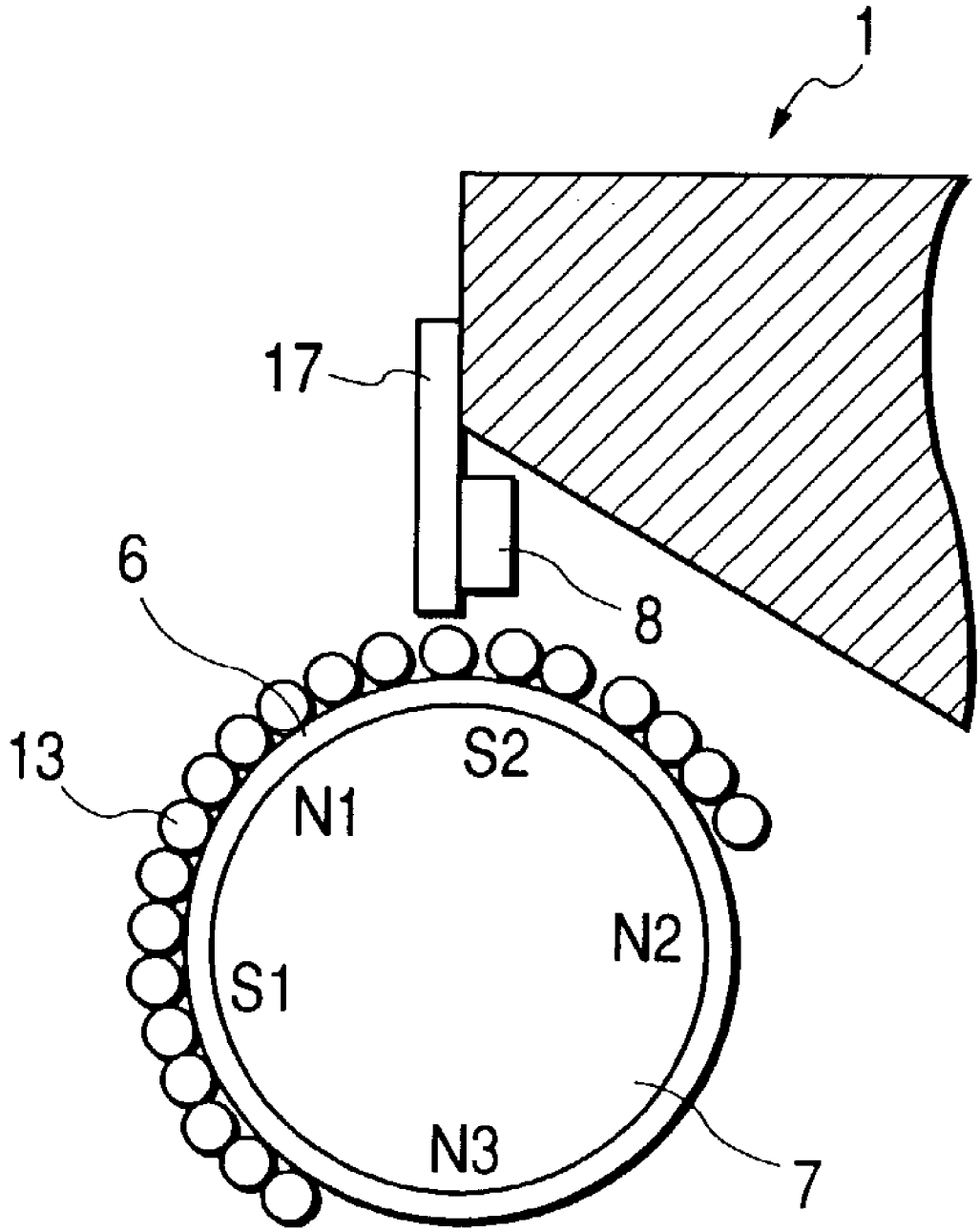
FIG. 4 is an enlarged sectional view showing an example of magnetic means in accordance with the present invention.

It is advantageous in terms of space-saving and cost reduction if a first magnetic plate doubles as a regulating blade as in this embodiment. However, the first magnetic plate does not always have to double as the regulating blade depending upon specifications required by the apparatus. In addition, although the developer regulating member may be constituted only by a magnetic plate as in this embodiment, the magnetic plate 8 may be adhered to a nonmagnetic sheet metal 17 as shown in FIG. 4.

It is sufficient that the first magnetic plate 8 or the second magnetic plate 16 is formed of a ferromagnetic body such as iron, nickel, or ferromagnetic SUS, or a magnetic body magnetized by a magnetic force of a magnetic roller such as plastic containing a magnetic component, and a thickness thereof is preferably about 0.3 to 3 mm. If it is too thin, a magnetic force attracting a magnetic roller is weak, and no effect is expected.

In the developing apparatus using two or more developing sleeves constituted as described above, even in the case in which developing sleeves of a small diameter is used, bending of a magnetic roller can be prevented to eliminate image failure due to coating unevenness or the like.

Second Embodiment

This embodiment is assumed to be the same as the first embodiment except points described below.

Figure 5:
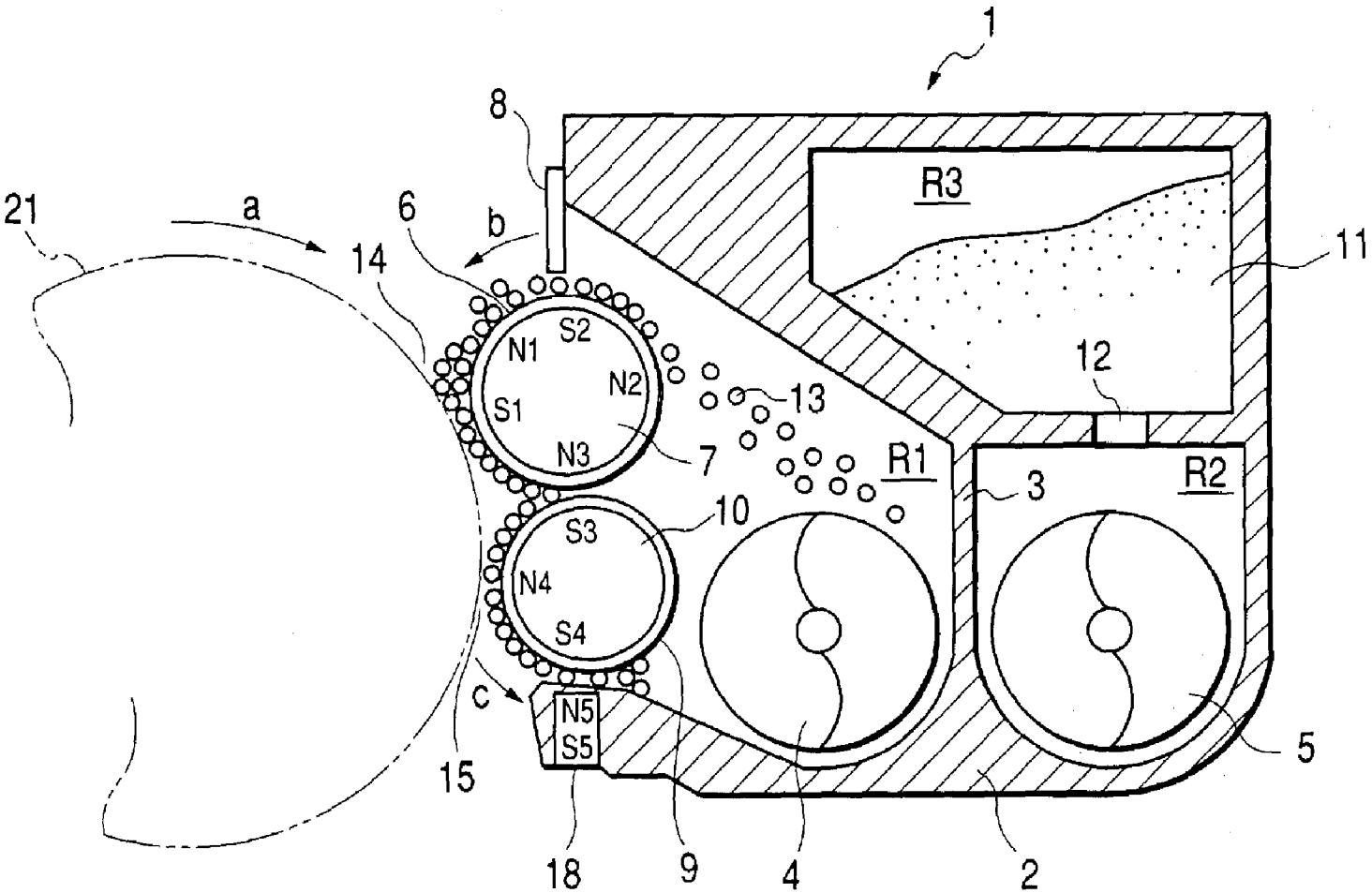
FIG. 5 is a sectional view showing another example of the developing apparatus in accordance with the present invention.

This embodiment will be described with reference to FIG. 5. In the first embodiment, the magnetic plate 8 is arranged so as to be opposed to the magnetic pole S4. In this embodiment, a permanent magnet 18, which is a plate-like magnetic field generating member whose pole N5 is opposed to the pole S4 of the second magnetic roller 10, is disposed as magnetic means across the developer container 2 so as to form a magnetic field in a vertical direction between the pole N5 and the pole S4 in the coverage of the magnetic force of the pole S4. Compared with the magnetic plate 8 of the first embodiment, it is possible to attract the magnetic roller 7 more strongly if the permanent magnet 18 as in this embodiment is used. Note that, in this embodiment, a magnetic flux density of the magnetic pole N5 is set to 50 mT with respect to a magnetic flux density 60 mT of the magnetic pole S4.

As to this magnetic flux density, bending of the magnetic rollers 7 and 10 can be prevented most by making a ratio of magnetic flux densities of adjacent magnetic poles of the magnetic rollers 7 and 10 in the two developing sleeves 6 and 9 (in this embodiment, a ratio of magnetic flux densities of the pole N3 and the pole S3) and a ratio of magnetic flux densities of adjacent magnetic poles of the permanent magnet 18 and the magnetic roller 10 (in this embodiment, a ratio of magnetic flux densities of the pole S4 and the pole N5) substantially equal. However, the density is determined depending upon the shape, the size, and the position of the permanent magnet 18.

It is sufficient that this permanent magnet 18 is formed of a material which in itself has magnetic poles such as fixed magnet, a plastic magnet containing magnetic powder, or magnetized metal, and may be adjusted to have a necessary magnetic force by adjusting the type, the size, and the like thereof.

Note that, in this embodiment, a reason for disposing the permanent magnet 18 on the outer side of the container 2 is to prevent the developer 13 from remaining on the permanent magnet 18 serving as a magnetic force member, which causes holdup or the like of the developer 13 in a part for taking in the developer 13 into the developer container 2, resulting in hindering of a smooth flow of the developer 13. The permanent magnet may be provided in the container 2 if a magnetic force is adjusted appropriately.

The objects of the present invention are attained by the above-mentioned structure.

Third Embodiment

Figure 6:
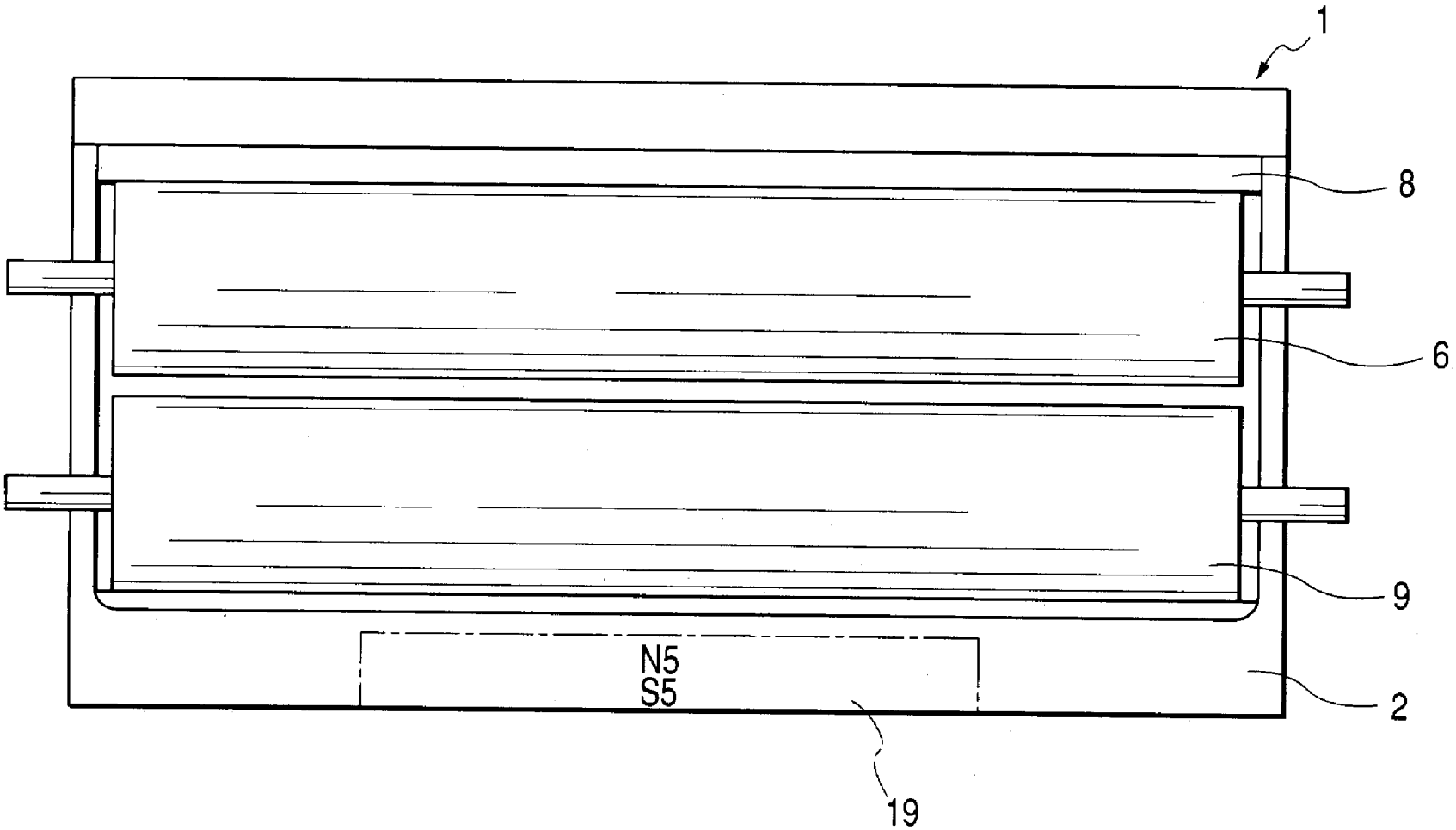
FIG. 6 is a longitudinal front view showing another example of the developing apparatus in accordance with the present invention.
Figure 7:
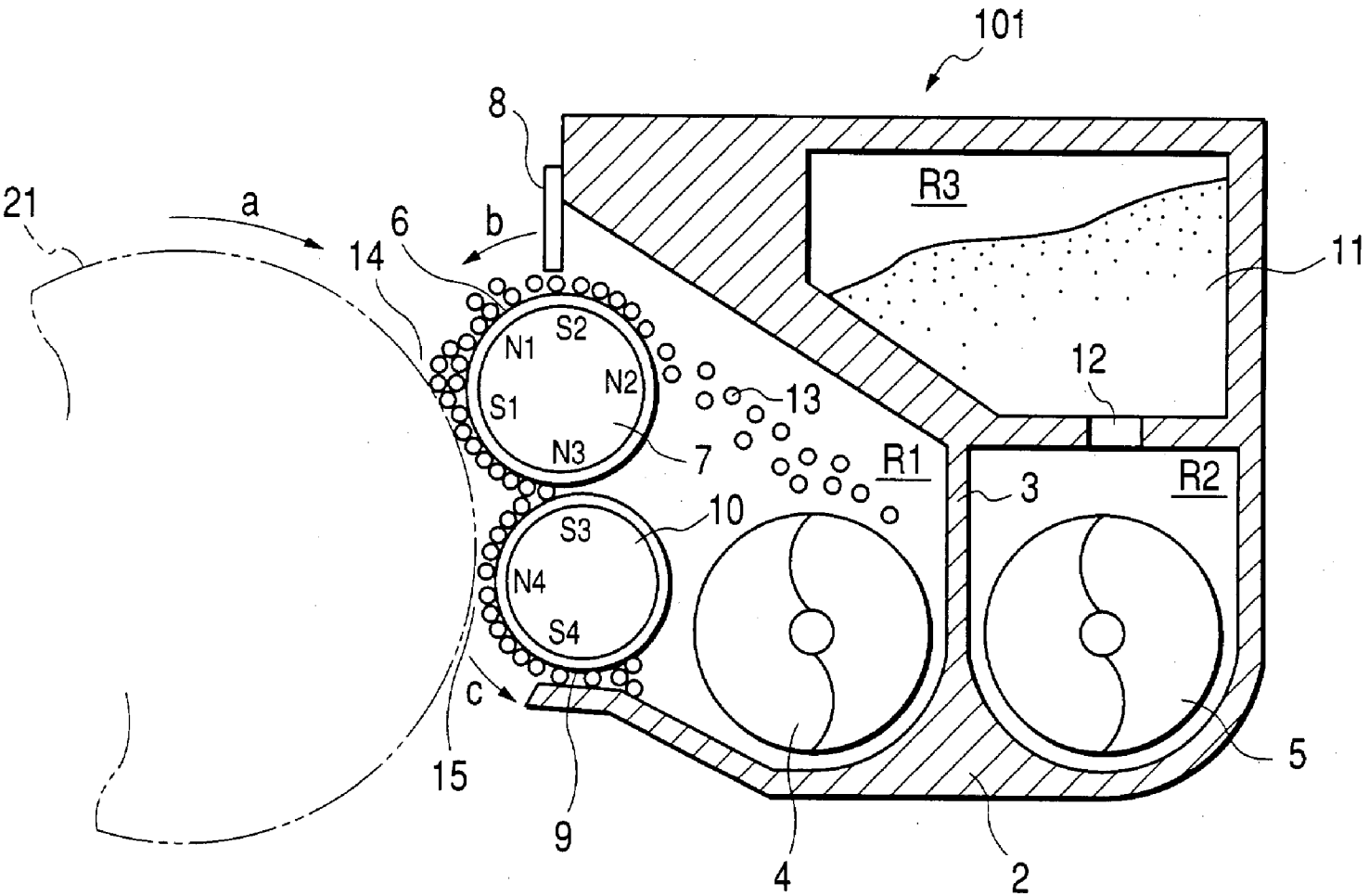
FIG. 7 is a sectional view showing an example of a conventional developing apparatus.

This embodiment is assumed to be the same as the first embodiment except for the points described below. The developing apparatus 1 of this embodiment is shown in a sectional view of FIG. 6 in which the developing apparatus is viewed from a longitudinal direction thereof.

Since the bending due to the magnetic force between the magnetic rollers 7 and 10 is the largest in a central part in a longitudinal direction of the developing sleeves 6 and 9, a permanent magnet 19 is disposed as a magnetic field generation member serving as magnetic means in the central part in the longitudinal direction of the developing sleeves 6 and 9 in a range of ±2 cm, in the coverage of the magnetic force of the magnetic pole S4 of the second magnetic roller 10 inside the second developing sleeve 9, and outside the developing container 2. A magnetic force generated by the permanent magnet 19, which is against the magnetic force between the magnetic rollers 7 and 10, is given to the central part of the second magnetic roller 10, whereby the bending of the second magnetic roller 10 is prevented. That is, a length of the permanent magnet 19 in the longitudinal direction is shorter than a length of the magnetic roller 10 in the developing sleeve 9. The permanent magnet 19 with such length is arranged in the central part where bending tends to occur.

Note that, it is possible to set the length of the magnetic means shorter than the length of the magnetic roller to arrange it in a central part of the developing sleeves as described above even if the magnetic means is not a permanent magnet like that in this embodiment but is a magnetic plate like that in the first embodiment, provided that it does not double as a developer regulating member. However, also in this case, the magnetic means is provided within coverage of a magnetic force of the magnetic rollers.

Consequently, it becomes possible to reduce costs and a space of a magnetic force member.

Note that, in the above-described developing apparatus and image forming apparatus of the present invention, it is also possible to provide more than two developer carrying members. At least any two developer carrying members among them have peripheral surfaces adjacent to each other, and the present invention is applied to the adjacent developer carrying members. In the case in which three or more developer carrying members are provided in series with peripheral surfaces thereof being adjacent to each other, a developer carrying member in a most upstream position in a moving direction of an image bearing member is assumed to be a first developer carrying member, and a developer carrying member in a most downstream position in the moving direction of the image bearing member is assumed to be a second developer carrying member. The magnetic means of the present invention can be provided in these first and second developer carrying members, and the effects described in the first to third embodiments can be obtained.

In addition, magnetic developers are not limited to the above-mentioned ones, and the present invention can be applied to a monochrome image forming apparatus.

This monochrome image forming apparatus is substantially the same as the image forming apparatuses of the above-mentioned embodiments except that a developer container contains a one component magnetic toner serving as a magnetic developer.

To describe the image forming apparatus briefly, it performs development in both the first developer carrying member and the second developer carrying member while delivering the one component toner from the first developer carrying member to the second developer carrying member. In addition, in this case, a regulating member may be arranged in abutment with the first developer carrying member in order to triboelectrify the one component magnetic toner carried on the first developer carrying member.

As described above, according to the above-mentioned embodiments, bending of the first and second magnetic field generation means can be prevented, and image failure such as coating unevenness of a developer and damage to a developing apparatus due to this bending can be avoided. Moreover, it also becomes possible to realize miniaturization of the developing apparatus.

Note that it is needless to mention that the various components described in the above-mentioned embodiments can be modified as long as the modification is within the scope of the idea of the present invention.

What is claimed is:

1. A developing apparatus for developing an electrostatic image formed on an image bearing member, comprising:

a developer container which contains a magnetic developer;

first and second developer carrying members which carry the developer in the developer container to the image bearing member;

first magnetic field generation means, which is fixedly arranged in the first developer carrying member;

second magnetic field generation means, which is fixedly arranged in the second developer carrying member, wherein a magnetic field for transferring the developer from the first developer carrying member to the second developer carrying member is generated in an adjacent area, which is adjacent to the first magnetic field generation means and the second magnetic field generation means;

a first magnetic member, which is arranged in proximity to the first developer carrying member and is magnetized by the first magnetic field generation means;

a second magnetic member, which is arranged in proximity to the second developer carrying member and is magnetized by the second magnetic field generation means, wherein the first magnetic member is positioned at an approximately opposite side of the first developer carrying member with respect to the adjacent area, and a magnetic force generated between the first magnetic member and the first magnetic field generation means affects in a direction of reducing bending of the first magnetic field generation means, the bending being generated by a magnetic force of the adjacent area, and wherein the second magnetic member is positioned at an approximately opposite side of the second developer carrying member with respect to the adjacent area and a magnetic force generated between the second magnetic member and the second magnetic field generation means affects a direction of reducing of the bending of the second magnetic field generation means, the bending being generated by magnetic force of the adjacent area.

2. A developing apparatus according to claim 1, wherein the first magnetic member regulates a layer thickness of the developer carried on the first developer carrying member.

3. A developing apparatus according to claim 1, wherein the magnetic developer includes a nonmagnetic toner and a magnetic carrier.

* * * * *

UNITED STATES PATENT AND TRADEMARK OFFICE

CERTIFICATE OF CORRECTION

PATENT NO. : 6,978,108 B2
DATED : December 20, 2005
INVENTOR(S) : Tomoyuki Sakamaki It is certified that error appears in the above-identified patent and that said Letters Patent is hereby corrected as shown below:

Title page,
Item [75], Inventors "Tomoyuki Sakamaki, Kanagawa (JP)" should read -- Tomoyuki Sakamaki, Ibaraki (JP) --.

Column 6,
Line 51, "and id" should read -- and 1*d* --.

Column 9,
Line 7, "pole Si" should read -- pole S1 --.

Column 14,
Line 21, "means;" should read -- means; and --; and
Line 41, "by magnetic" should read -- by a magnetic --.

Signed and Sealed this

Sixth Day of June, 2006

JON W. DUDAS
*Director of the United States Patent and Trademark Office*